US007223129B1

(12) United States Patent
Lopez et al.

(10) Patent No.: US 7,223,129 B1
(45) Date of Patent: May 29, 2007

(54) VEHICLE POWER SYSTEM WITH WIRE SIZE ADAPTER

(75) Inventors: Alberto A. Lopez, St. Petersburg, FL (US); John Catalano, Palm Harbor, FL (US); Nathan Wincek, New Port Richey, FL (US)

(73) Assignee: AAMP of Florida, Inc., Clearwater, FL (US)

( * ) Notice: Subject to any disclaimer, the term of this patent is extended or adjusted under 35 U.S.C. 154(b) by 0 days.

(21) Appl. No.: 11/317,539

(22) Filed: Dec. 23, 2005

(51) Int. Cl.
*H01R 9/22* (2006.01)

(52) U.S. Cl. ..... 439/709; 174/59; 439/621; 439/814; 439/957

(58) Field of Classification Search ..... 439/471, 439/723, 724, 535, 620.27, 709, 621, 814, 439/957; 174/59
See application file for complete search history.

(56) References Cited

U.S. PATENT DOCUMENTS 4,040,701 A * 8/1977 Gressitt ..... 439/405
5,171,942 A 12/1992 Powers
5,997,367 A * 12/1999 Nowak et al. ..... 439/853
6,005,193 A 12/1999 Markel
6,123,573 A * 9/2000 Savicki, Jr. ..... 439/469
6,137,058 A 10/2000 Moe et al.
6,353,177 B1 3/2002 Young
6,746,279 B1 * 6/2004 Lopez ..... 439/620.01
6,921,292 B2 * 7/2005 Miyazaki ..... 439/564

* cited by examiner

*Primary Examiner*—Michael C. Zarroli
(74) *Attorney, Agent, or Firm*—Larson & Larson, PA; Frank Liebenow

(57) ABSTRACT

A power system with graphics display includes a wire size adapter that is a conductive ring that has an outer diameter sized to fit snuggly into an input terminal of the power system and has an inner diameter sized to fit snuggly around a power wire that is smaller than the wire size normally accepted by the input terminal.

20 Claims, 9 Drawing Sheets

VEHICLE POWER SYSTEM WITH WIRE SIZE ADAPTER

BACKGROUND OF THE INVENTION

This application is related to co-pending U.S. application titled, "VEHICLE POWER SYSTEM WITH INTEGRATED GRAPHICS DISPLAY," which was filed on Dec. 23, 2005, Ser. No. 11/317,535; and inventors Alberto A. Lopez, John Catalano and Nathan Wincek. Additionally, this application is related to co-pending U.S. application titled, "VEHICLE POWER SYSTEM UTILIZING OVAL WIRE," which was filed on Dec. 23, 2005, Ser. No. 11/317,699; and inventors Alberto A. Lopez, John Catalano and Nathan Wincek. Additionally, this application is related to co-pending U.S. application titled, "VEHICLE POWER SYSTEM WITH ROTATBLE MAIN ASSEMBLY," which was filed on Dec. 23, 2005, Ser. No. 11/318,221; and inventors Alberto A. Lopez, John Catalano and Nathan Wincek.

1. Field of the Invention

The present invention relates to the field of conditioning or distributing power within an oval or elliptical wire and more particularly to an apparatus that provides for wire size adapters for multiple wire sizes.

2. Description of the Related Art

Automotive accessories are becoming more functional and decorative. High power audio amplifiers, lighting systems, automation systems and even waterfalls have been installed in vehicle doors, passenger compartments and trunks. These devices utilize large amounts of power and put significant loads on the vehicle's power distribution systems. The art has many examples of vehicle power distribution, including U.S. Pat. No. 6,746,279, "Power Distribution System," to Lopez, which is hereby incorporated by reference. This patent describes a power distribution and fusing system that accepts one or two larger power wires, fuses the power and distributes the power over several smaller gauge wires.

Additionally, there is a need for lighting and display. U.S. Pat. No. 6,181,563, "Meter Device for Vehicle," to Shimbu, et al, describes a vehicle metering and display device and is hereby incorporated by reference. This device has a display for displaying vehicle speed and engine speed, for example. The display is mounted in the passenger compartment and visible to the driver. The device of this patent does not distribute power to other devices. Furthermore, the display is provided for displaying information according to signals from the electronic component units integrated into the device and not enabled to accept external, fully-graphical video sources.

Historically, power has been distributed by a single power cable carrying one voltage potential, usually positive, and the frame of the vehicle carrying the other voltage potential, usually negative. The power cables of the prior art are generally heavy gauge, stranded wire of a size suitable for carrying the current required by the load. Standard wire comes in sizes that are numbered based upon its diameter and hence current carrying capacity with the higher numbers used for smaller wire having lower current carrying capacity. For heavy loads, a larger wire size is used. Unfortunately, as more current is required, the wire diameter increases requiring higher-profile connecting devices, causing difficulty in bending and shaping the wire and, when run under carpet, creating bumps and bulges. Oval shape wire has been used in very narrow applications for delivering high-voltage power in the AC power grid. For example, U.S. Pat. No. 5,171,942 to Wilber F. Powers, issued Dec. 12, 1992, describes a specialized oval wire for overhead high tension lines and is hereby incorporated by reference. This patent describes a very special type of oval power line and does not imply any other use for such oval cable. In another example, U.S. Pat. No. 6,353,177 B1 to Walter W. Young, issued Mar. 5, 2002 describes a cable of oval form, but the core conductor is round and the insulator is oval. This type of power cable has all the issues related to a round cable described above with no advantage for automotive use. The oval design of its insulation improves its wind resistance which is not an issue in automotive applications.

Unfortunately, there is a lack of power conditioning, fusing, and/or distribution devices utilizing oval or elliptical wire of various wire sizes in the art.

What is needed is an apparatus that will provide a power distribution system that adapts to various wire sizes.

SUMMARY OF THE INVENTION

An object of the present invention is to provide a power distribution device that includes power inputs intended for a specific wire size and provides adapters for use with smaller sized wire.

In one embodiment, automotive wire size adapter for use in a terminal block of an automotive power distribution system is disclosed including an elliptical ring having a length, an inner diameter and an outer diameter. The length is substantially the depth of the terminal block, the inner diameter is sized to accept a stripped end of an elliptical power wire and the outer diameter is sized to fit with the terminal block.

In another embodiment, method for adapting a smaller sized wire into a terminal block of an automotive power distribution device is disclosed including providing an automotive power distribution system having an enclosure, a plurality of power terminal blocks situated on the periphery of the enclosure and a power distribution device housed within the enclosure. The power distribution device adapted to accept power from one of the plurality of power terminal blocks and the power distribution device adapted to deliver power to another of the plurality of power terminal blocks. The method continues by providing an automotive wire size adapter sized for a selected terminal block of said plurality of terminal blocks and sized for the smaller sized wire. The adapter is an elliptical ring with a length, an inner diameter and an outer diameter and the length is substantially the depth of the selected terminal block, the inner diameter is sized to accept a stripped end of the smaller power wire and the outer diameter is sized to fit with the selected terminal block. The method continues with striping an end of the smaller sized wire and inserting the stripped end of the smaller sized wire into the automotive wire size adapter then inserting the automotive wire size adapter into the selected terminal block and tightening a set screw of the selected terminal block, thereby physically holding the automotive wire size adapter and the smaller sized wire firmly within the selected terminal block.

In another embodiment, an automotive wire size adapter for use in a terminal block of an automotive power distribution system is disclosed including an adapter having a length, an inner diameter and an outer diameter. The length is substantially the depth of the terminal block, the inner diameter is sized to accept a stripped end of an elliptical power wire and the outer diameter is sized to fit with the terminal block.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
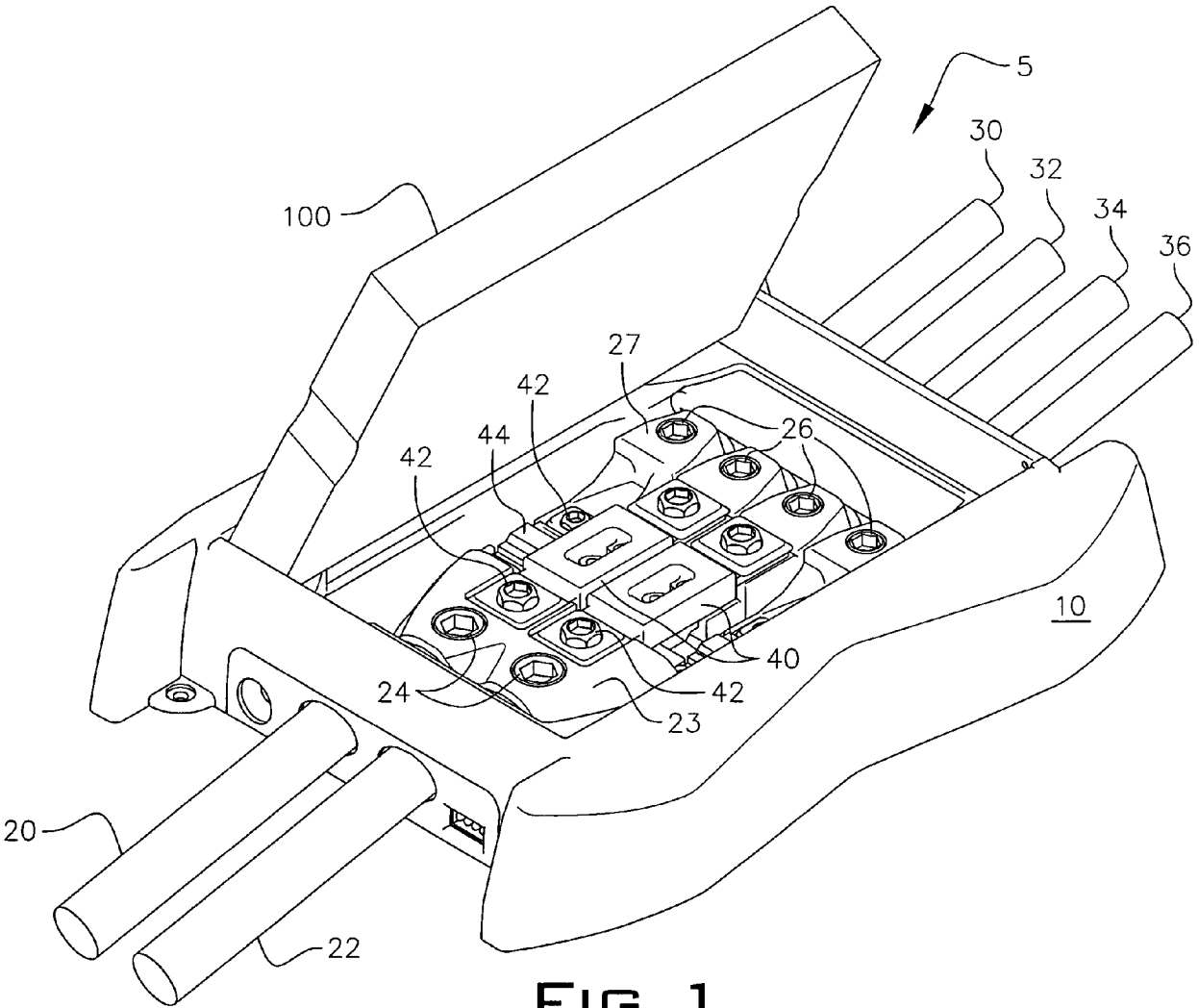
FIG. 1 illustrates a perspective view of the apparatus of the present invention.

Reference will now be made in detail to the presently preferred embodiments of the invention, examples of which are illustrated in the accompanying drawings. Throughout the following detailed description, the same reference numerals refer to the same elements in all figures. In the description of the device for distributing power of the present invention, the perspective views include a display and a power option having two power inputs, a plurality of fuses and four power outputs. This is an example of one possible configuration, whereas any number of inputs and outputs as well as several different power options are described later and can be installed into the same housing. The graphics display is multipurpose, in that it is useful for displaying video such as a video stream from a DVD player and text as well as emitting a wide range of colors and patterns, providing both aesthetic as well as safety features.

Referring to FIG. 1, a perspective view of the apparatus of the present invention is shown. The power distribution system 5 includes an outer case 10 with a display (not visible) housed within a display housing 100. The power distribution system 5 has a rotatable and exchangeable power distribution device allowing configuration with various power options that can be oriented so that power enters on the left side and exits on the right side or visa-versa, providing flexibility in the viewing direction of the display. The power distribution system 5 in this embodiment has two power inputs 20/22 connected through a power input connector, in this embodiment, a terminal block 23 and physically/electrically held by set screws 24. The terminal block is sized to accept a specific size of wire. In some embodiments, the wire is oval or elliptical so that it lies flat when routed through a vehicle, especially under carpet, bends easy and so that the power distribution system can be designed to have a lower profile than if round wire is used. The inputs 20/22 are connected to a first terminal 42 of the fuses 40/44. In this embodiment, two types of fuses are installed 40/44 but in some embodiments, only one type of fuse is installed providing flexibility in protection for each output 30/32/34/36 in that a first type of fuse has current ranges up to 40 amps, while another type fuse has current ranges up to 750 amps. The second terminal 42 of the fuses 40/44 is connected to a power output connector, in this embodiment, a second terminal block 27 for connection to the output power cables 30/32/34/36, held electrically/physically with set screws 26.

Figure 2:
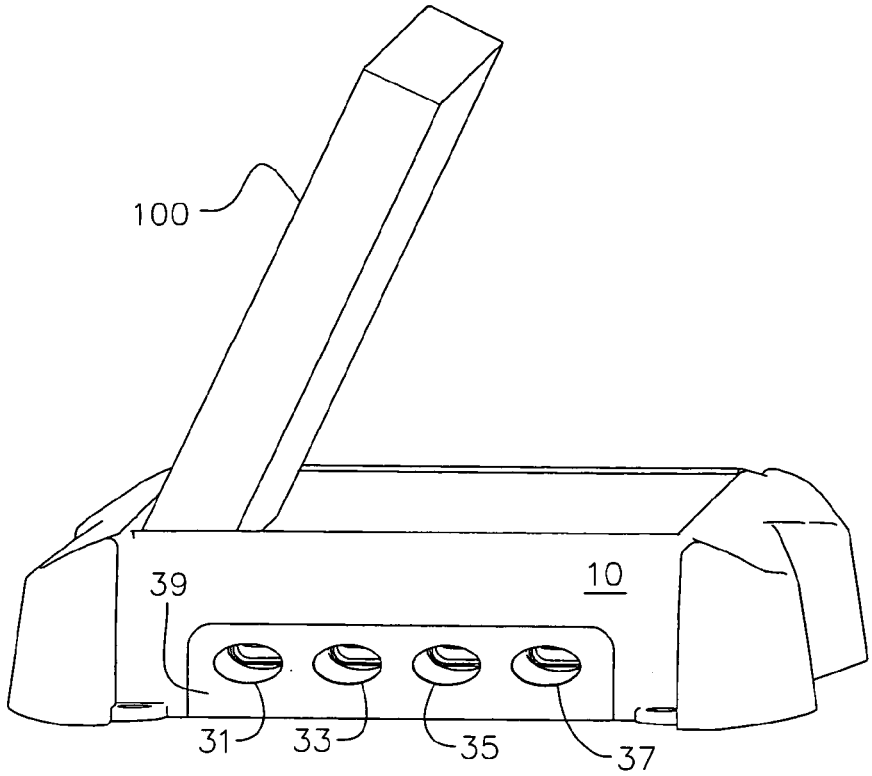
FIG. 2 illustrates a right-side perspective view of the present invention.

Referring to FIG. 2, a right-side perspective view of the present invention is shown. The case 10 has a side cut-out that is filled with a surface 39 of the power distribution module and has four openings 31/33/35/37 configured to accept four output power cables (30/32/34/36 from FIG. 1). The display housing 100 is shown slightly tilted. In this embodiment, the display is rotatably coupled to the outer case 10 allowing adjustment to its angles.

Figure 3:
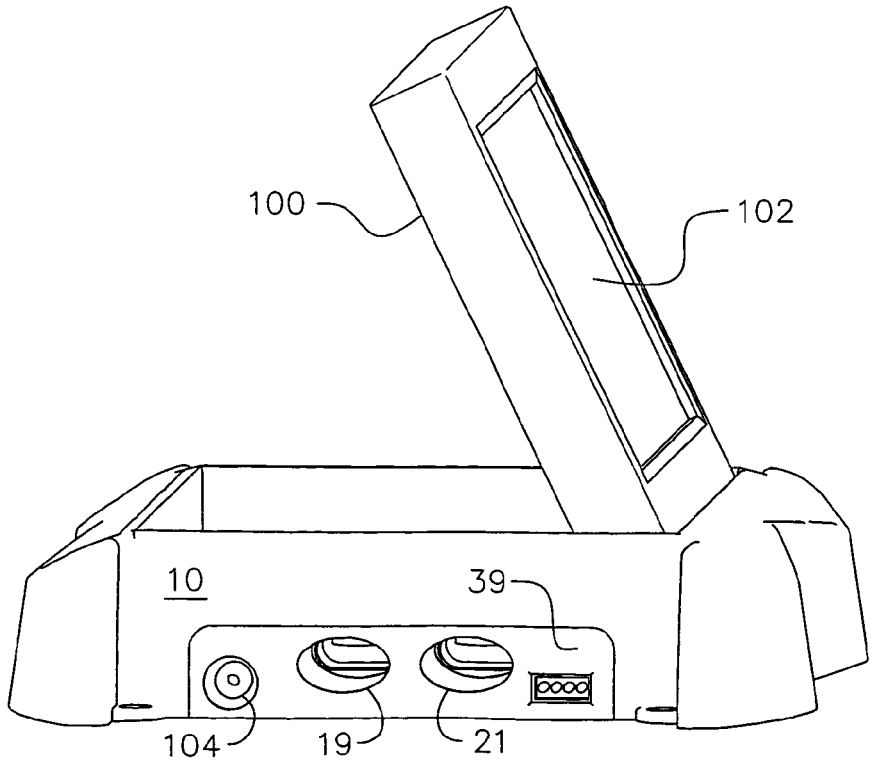
FIG. 3 illustrates a left-side perspective view of the present invention.

Referring to FIG. 3, a left-side perspective view of the present invention is shown. The outer case 10 has a side cut-out that is filled with a surface 39 of the power distribution module and has two openings 19/21 configured to accept two input power cables (20/22 from FIG. 1). The display housing 100 is shown slightly tilted and the display 102 is visible. The display 102 is of any flat panel display technology known in the industry, including but not limited to plasma, liquid crystal display (LCD), etc. In this embodiment, a video input connector 104 is provided for providing a video source to the display 102. In some embodiments, display content is generated internally, providing varying colors, patterns and lighting effects.

Figure 4:
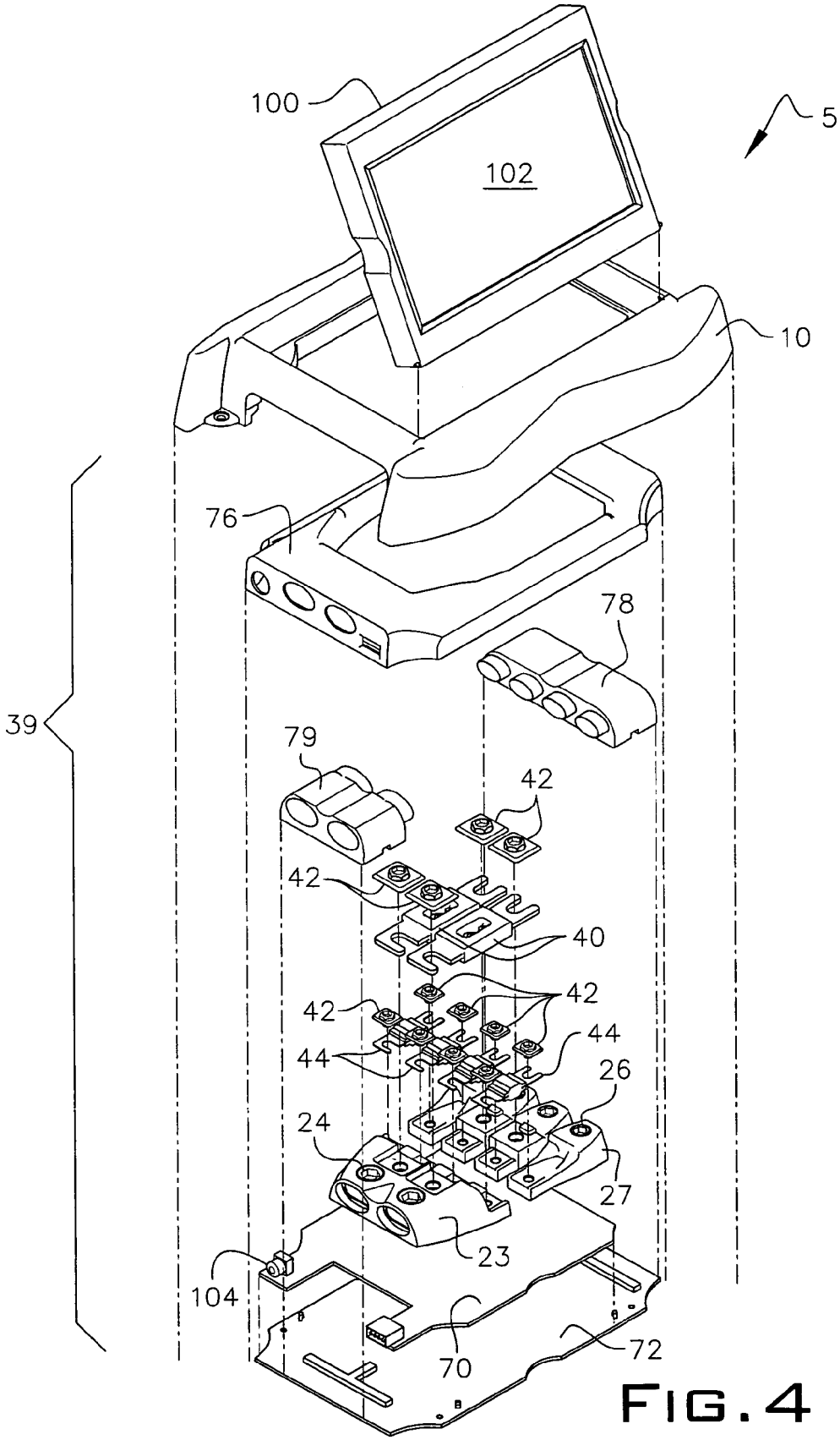
FIG. 4 illustrates an exploded view of the present invention.

Referring to FIG. 4, an exploded view of the present invention is shown. The power distribution system 5 includes an outer case 10 with a display 102 housed within a display housing 100 that is hingedly connected to the outer case 10. The power distribution system 5 has rotatable and exchangeable power distribution devices configurable with various power options that can be oriented so that power enters on the left side and exits on the right side or visa-versa, providing flexibility in the viewing direction of the display. The power distribution system 5 in this embodiment has two power input connectors which are, in this embodiment, a terminal block 23. The input power wires are physically and electrically held by set screws 24. The inputs are connected to a first terminal 42 of the fuses 40/44. In this embodiment, two types of fuses are installed 40/44, In some embodiments, only one type of fuse 40 or the other 44 is installed providing flexibility in protection for each output. The second terminal 42 of the fuses 40/44 is connected to a second power output connector, in this embodiment, a terminal block 27 for connection to the output power wires (30/32/34/36 in FIG. 1), held electrically/physically with set screws 26. The power distribution module 39 has a modular housing 76 that is symmetrical so that the power distribution module 39 is adaptable to be mounted within the outer case 10 in one orientation or in another opposite orientation, rotated 180 degrees horizontally. Wire guides 79 guide the two power input wires (20/22) into the terminal block 23 and wire guides 78 guide the power output wires (30/32/34/36) into the output terminal block 27. A circuit board 70 provides power and video distribution to the display 102 and holds the video input connector 104. In some embodiments, a graphics display controller (see FIG. 6) is mounted on the circuit board 70. A bottom cover 72 protects the circuit board and holds the power distribution module 39 within the outer case 10.

Figure 5:
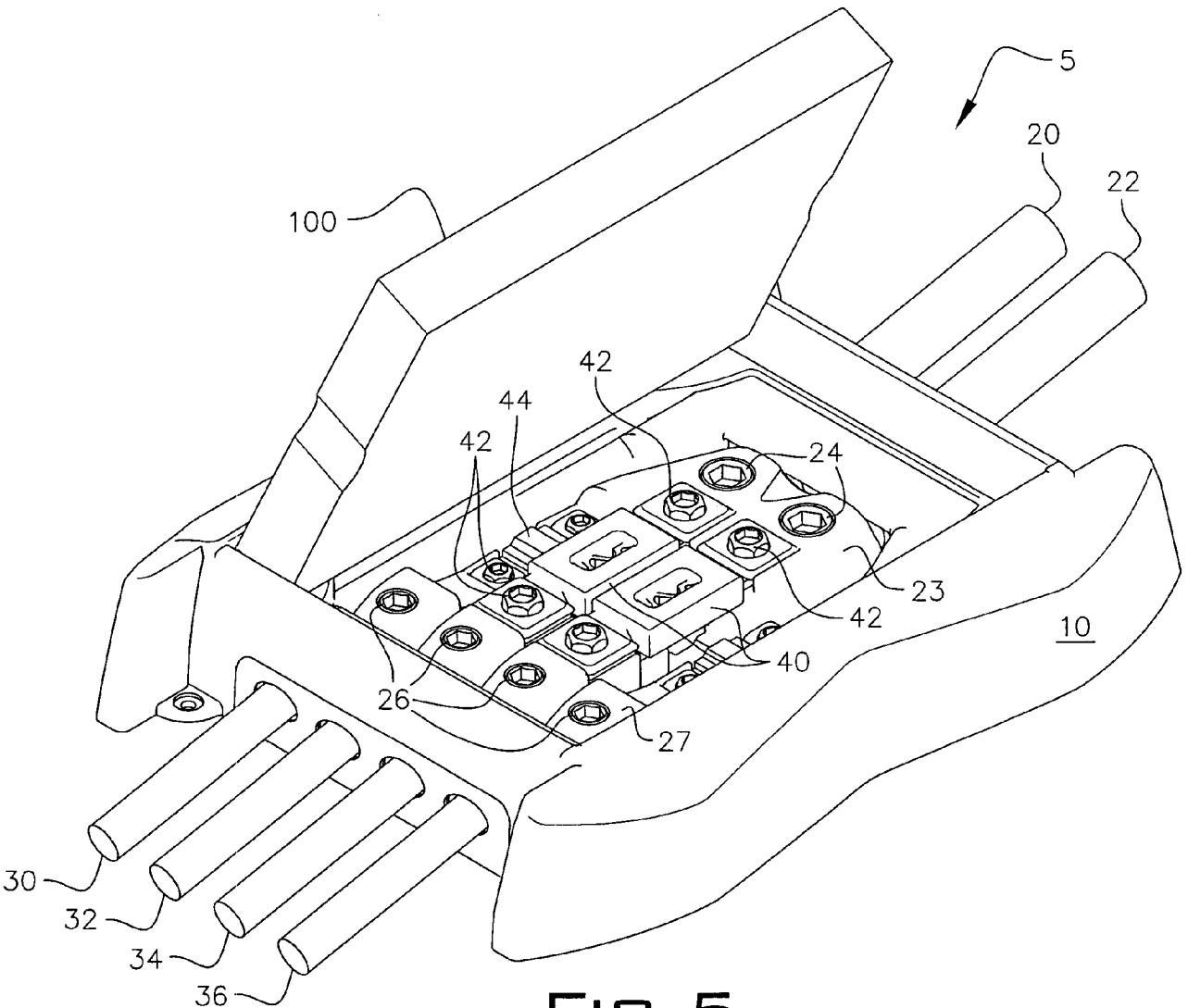
FIG. 5 illustrates a perspective view of the apparatus of the present invention configured for opposite connections to that of FIG. 1.

Referring to FIG. 5, a perspective view of the apparatus of the present invention configured for opposite connections to that of FIG. 1 is shown. The power distribution system 5 includes an outer case 10 with a display (not visible) housed within a display housing 100. The power distribution system 5 has a rotatable and exchangeable power distribution device configurable with various power options that can be oriented so that power enters on the left side and exits on the right side or visa-versa, providing flexibility in the direction of the display. The power distribution system 5 in this embodiment has four power outputs 30/32/34/36 connected through a power output connector, in this embodiment a terminal block 27. The power output wires 30/32/34/36 are physically and electrically held by set screws 26. The outputs 30/32/34/36 are connected to a first terminal 42 of the fuses 40/44. In this embodiment, two types of fuses are installed 40/44 but in some embodiments, only one type of fuse 40 or the other 44 is installed providing flexibility in protection for each output 30/32/34/36. The second terminal 42 of the fuses 40/44 is connected to a power input connector, in this embodiment a terminal block 23 for connection to the input power wires 20/22. The input power wires 20/22 are electrically and physically coupled with set screws 24.

Figure 6:
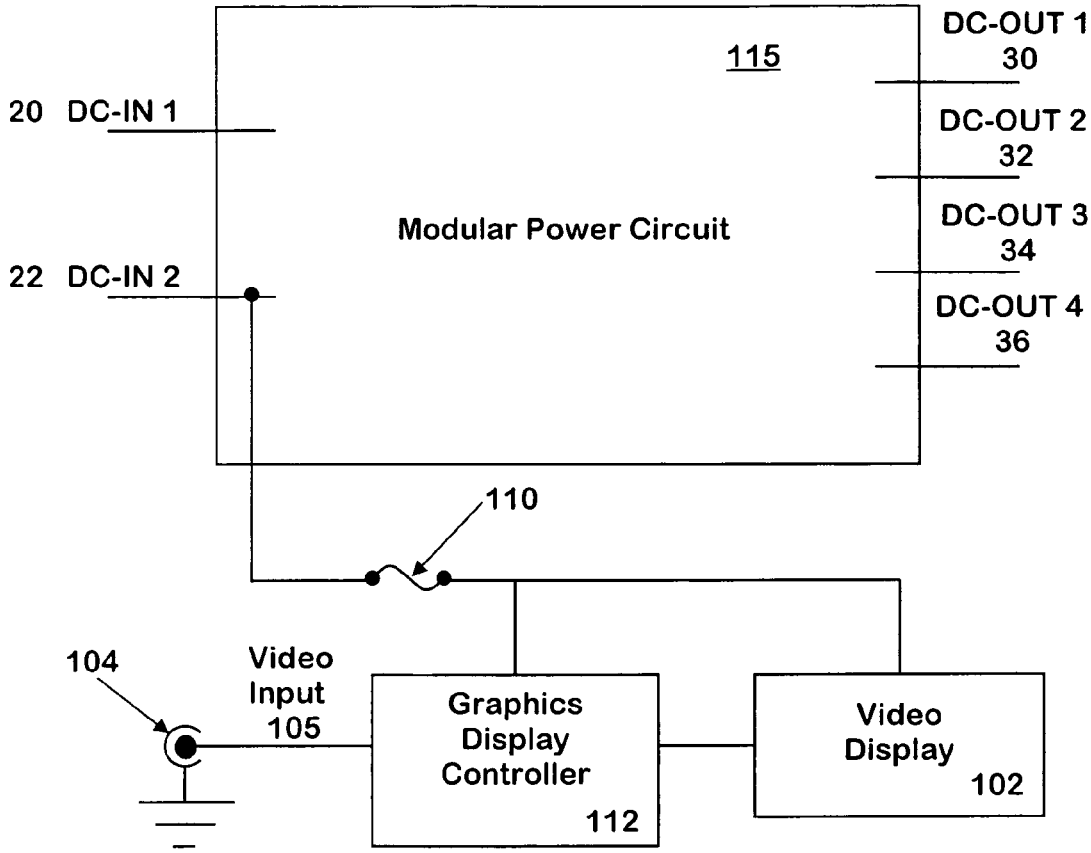
FIG. 6 illustrates a schematic diagram of the common electronics of the present invention.

Referring to FIG. 6, a schematic diagram of the common electronics of the present invention is shown. In this embodiment, two DC inputs 20/22 enter the power distribution device or modular power circuit 115. In other embodiments, one, three, four or any number of DC inputs is present. The content and function of the power distribution device 115 will be described in the description of FIGS. 7–10. Generally, the power distribution device 115 is a device that accepts power from a power source and distributes the power to one or more power outputs. In some embodiments, the power distribution device 115 provides protection by way of fuses or surge suppressors or provides power conditioning.

Also in this embodiment, four DC outputs 30/32/34/36 exit the power distribution device 115. In other embodiments, one, two, three or any number of outputs exit the power distribution device 115. A connection to one of the DC inputs 22 is made to derive power for the internal electronics, indicators and displays. In some embodiments, the power passes through a fuse 110 to protect from an overload in the internal electronics and display. In the present embodiment, the input video signal 105 from the video input connector 104 is routed to a graphics display controller 112 which accepts a video signal from the video connector 104 such as NTSC, RGB, S-video, composite video, SECAM, PAL and the like, decodes the signal and generated signals required by the video display 102, for example, LVDS (Low Voltage Differential Signal) and parallel. The display is preferably a liquid crystal display (LCD), but can be any flat panel display including Plasma.

In some embodiments, the graphics display controller 112 generates colors and patterns on the video display 102 independently of the video input 105. In these embodiments, there is a user interface (not shown) consisting of an input device such as a keyboard or keyboard and mouse (not shown), configured to accept commands from a user to set up the display colors, patterns and sequences.

Figure 7:
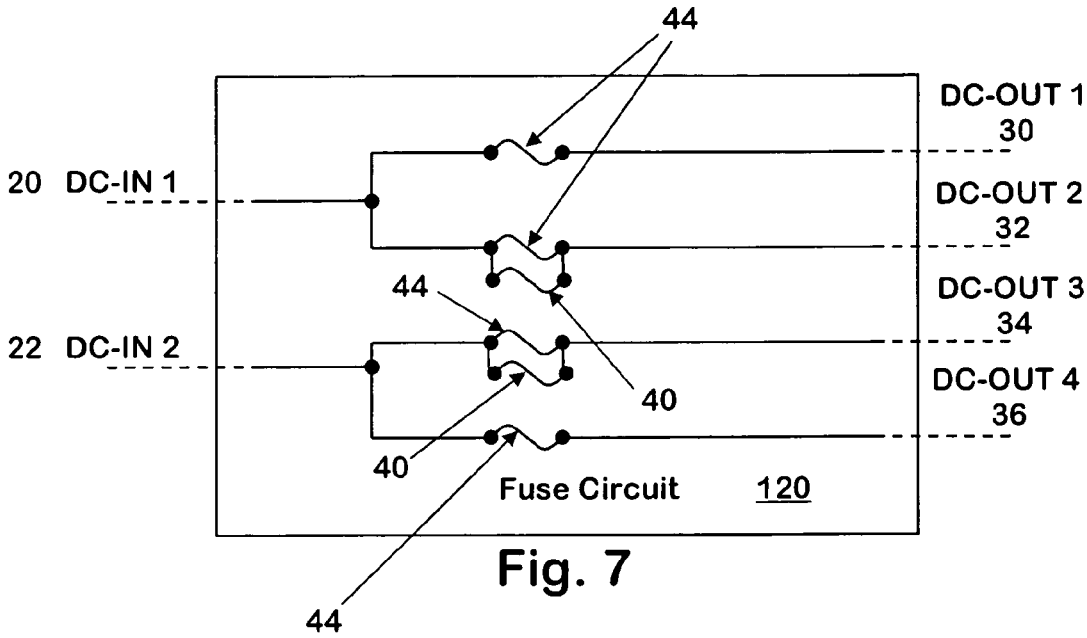
FIG. 7 illustrates a schematic diagram of a fused distribution option of the present invention.

Referring to FIG. 7, a schematic diagram of a fused distribution option 120 of the present invention is shown. The circuit shown includes two DC inputs 20/22 connected to four DC outputs 30/32/34/36 by fuses 40/44. Note that in some embodiments more than one type of fuse receptacle is deployed in parallel providing flexibility in fuse selection and current handling. By installing more than one fuse in parallel, the current handling capacity is increased.

Figure 8:
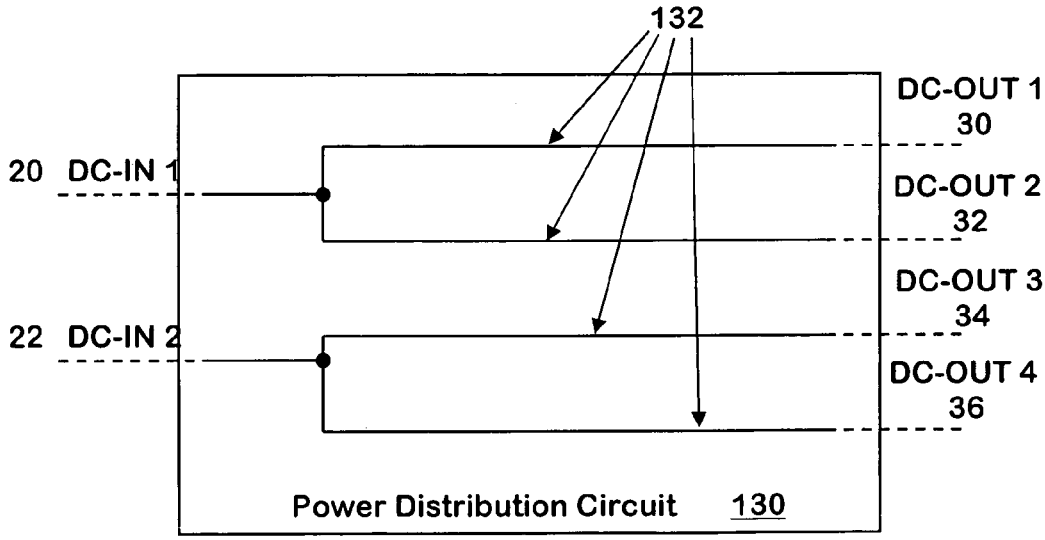
FIG. 8 illustrates a schematic diagram of a distribution block option of the present invention.

Referring to FIG. 8, a schematic diagram of a distribution block option 130 of the present invention is shown. The circuit includes two DC inputs 20/22 directly connected to four DC outputs 30/32/34/36 through wiring paths 132.

Figure 9:
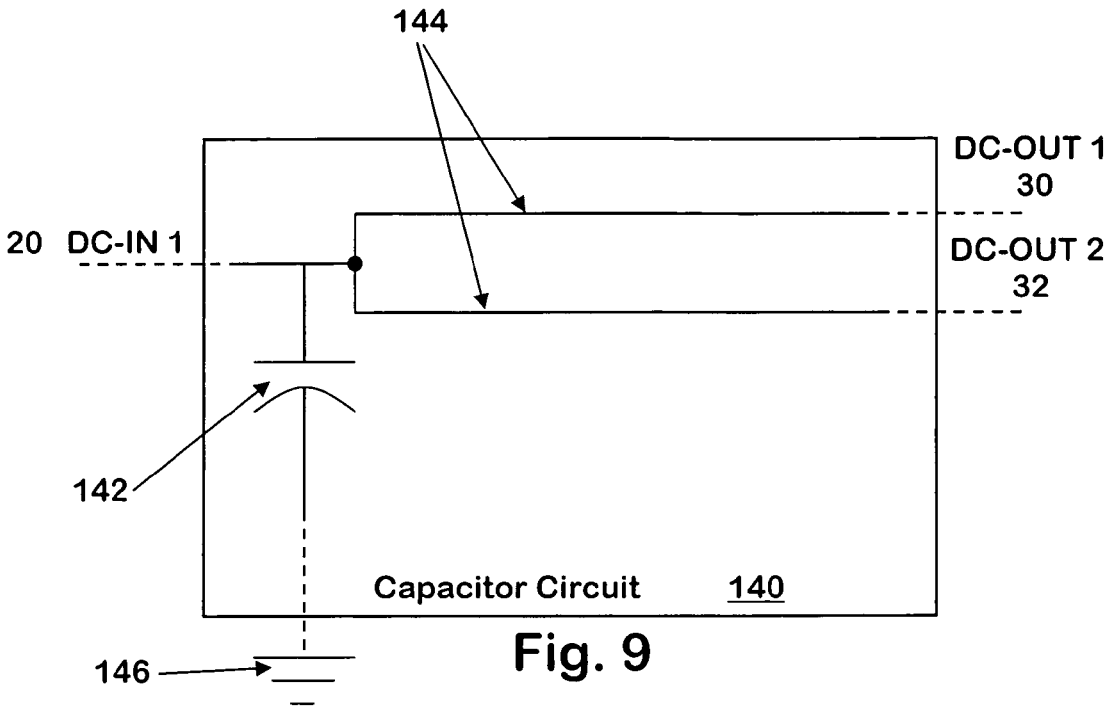
FIG. 9 illustrates a schematic diagram of a high capacity capacitor option of the present invention.

Referring to FIG. 9, a schematic diagram of a high capacity capacitor option 140 of the present invention is shown. The circuit includes a DC input 20 directly connected to two DC outputs 30/32 with a capacitor 142 between the DC input 20 and ground 146. The capacitor 142 is, for example, a high-capacity electrolytic or super capacitor. The value of the capacitor is, for example, 10–30 farads at 15 volts.

Figure 10:
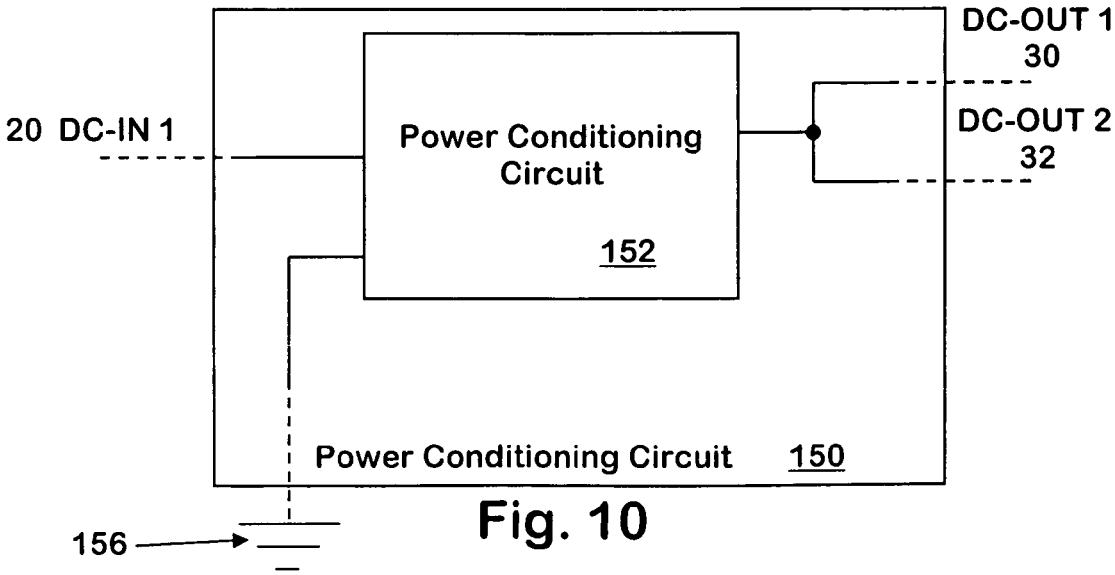
FIG. 10 illustrates a schematic diagram of a power conditioning circuit option of the present invention.

Referring to FIG. 10 illustrates a schematic diagram of a power conditioning circuit option 150 of the present invention. The circuit includes a DC input 20 that is conditioned with a power conditioning circuit 152 before passing to two DC outputs 30/32. The power conditioning circuit 152 is also connected to a ground 156. In some embodiments, the power conditioning circuit 152 includes circuitry to regenerate the standard 12V output by switching the DC input voltage at a high frequency into a transformer (e.g., a torroid transformer), then regulating and filtering the output of the transformer to conform to the required 12V output, thereby eliminating any voltage fluctuations and noise created by the vehicle's engine or high current devices such as starter motors, lights, power seats and the like.

Figure 11A:
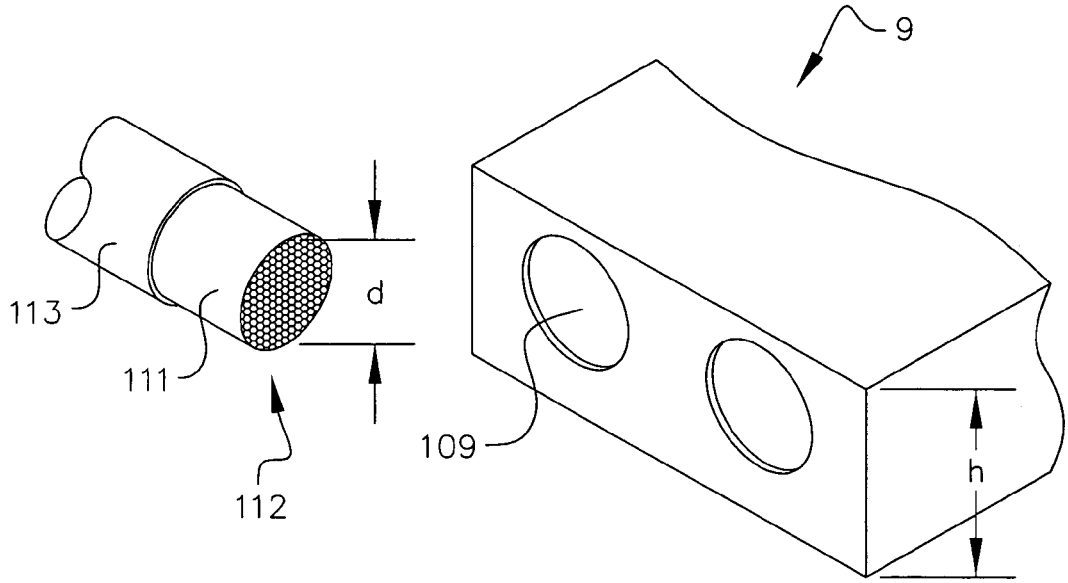
FIG. 11A (PRIOR ART)
FIG. 11*a* illustrates a power cable and a power distribution box of the prior art.

Referring to FIG. 11*a*, a wire or power cable and power distribution system of the prior art is shown. The power cable 112 is substantially round or tubular and has a central conductor 111 and an insulator 113. The power distribution system 9 of the prior art has a round receptacle 109 for accepting the power cable 112. The height, h, of the power distribution system 109 must be greater than the diameter, d, of the power cable 112.

Figure 11B:
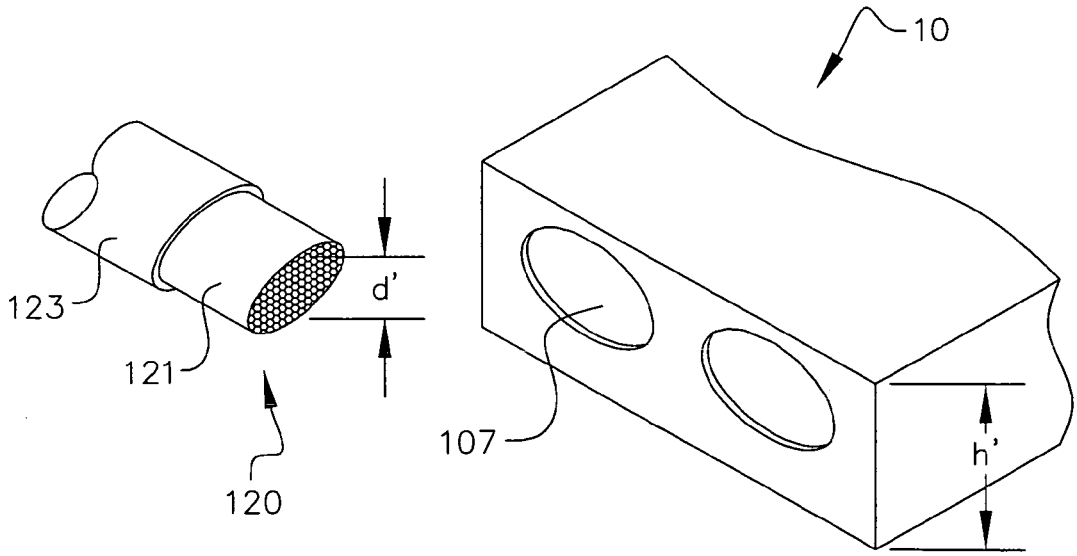
FIG. 11*b* illustrates a power cable and a power distribution box of the present invention.

Referring to FIG. 11*b*, a wire or power cable and power distribution system of the present invention is shown. The power cable 120 is substantially oval or elliptical and has a central conductor 121 that is also substantially oval or elliptical and an insulator 123 that is also substantially oval or elliptical. The power distribution system 10 of the present invention has an oval or elliptical receptacle 107 for accepting the power cable 120. The height, h', of the power distribution system 10 is greater than the diameter, d', of the power cable 120, but since the diameter d' of the elliptical cable 120 is smaller than the diameter d of the round cable 112, it is possible for the height h' of the power distribution system of the present invention to be less than the height h of the power distribution system of the prior art, providing a much lower profile power distribution system that looks better and fits better in tight compartments.

Figure 12:
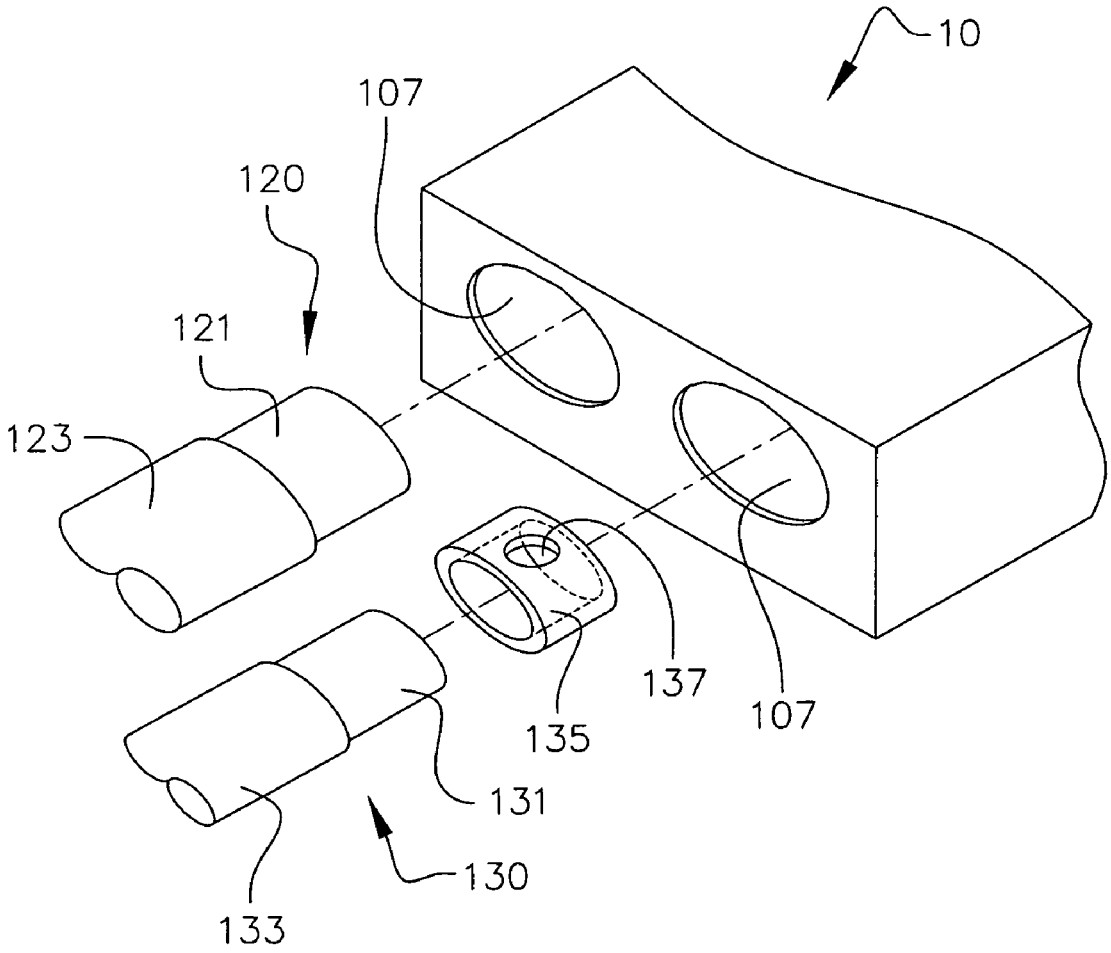
FIG. 12 illustrates a cable size adapter of the present invention.

Referring now to FIG. 12, a cable size adapter of the present invention is shown. The power distribution system 10 has openings and terminal blocks 107 that are sized to accept one size of wire 120. The insulation 123 of the wire 120 is stripped, exposing the oval conductor 121 which is then inserted into the power distribution terminal block 10 into the oval opening 107 where it is held in place by a set screw (shown in FIGS. 1, 4 and 5). The size of the openings 107 and terminal block are adapted to one specific size of wire. If a smaller wire 130 is used without an adapter 135, the set screw would not properly hold the wire in place and proper conduction would not be achieved. Instead, the smaller wire 130 has its insulation 133 stripped exposing its smaller oval conductor 131 and the exposed oval conductor 131 is inserted into a cable size adapter 135 and the smaller wire 130 and cable size adapter 135 are then inserted into the opening 107 and fastened with a set screw. Preferably, the cable size adapter 135 has an outer dimension equivalent to the inner dimension of the terminal block opening 107 so it fits snuggly within the terminal block opening 170. It is also preferred that the cable size adapter 135 has an inner dimension such that the stripped end 131 fits snuggly within the cable size adapter 135. Finally, it is preferred that the length of the cable size adapter 135 is roughly the same as the depth of the terminal block opening 107. In some embodiments, the cable size adapter 135 has a hole 137 sized to allow the set screw to pass through the cable size adapter 135 and apply pressure directly to the conductor 131. The adapter 135 is made from a conductive material, preferably copper or brass. In some embodiments, the adapter 135 is plated with another conductive metal such as nickel, brass, platinum, gold or silver.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. An automotive wire size adapter for use in a terminal block of an automotive power distribution system, the terminal block having at least one elliptical receptacle for accepting a striped end of an elliptical power wire, the automotive wire size adapter comprising:

an elliptical ring having a length, an inner dimension and an outer dimension;

whereas the length is substantially the same size as an insertion depth of the terminal block, the inner dimension is sized to accept the stripped end of the elliptical power wire and the outer dimension is sized to fit with the terminal block.

2. The automotive wire size adapter of claim 1, wherein the automotive wire size adapter is made from a conductive material selected from the group consisting of copper and brass.

3. The automotive wire size adapter of claim 2, wherein the automotive wire size adapter is plated with a conductive material selected from the group consisting of platinum, nickel, gold, silver and brass.

4. The automotive wire size adapter of claim 1, wherein the power distribution device passes power from at least one power input connector of the terminal block through at least one fuse to at least one power output connector of a second terminal block.

5. The automotive wire size adapter of claim 1, wherein the power distribution device passes power from at least one power input connector of the terminal block to at least one power output connector of a second terminal block and at least one capacitor is coupled between at least one power input connector and a ground potential.

6. The automotive wire size adapter of claim 1, wherein the power distribution device passes power from at least one power input connector of the terminal block through a power conditioning circuit to at least one power output connector of a second terminal block.

7. The automotive wire size adapter of claim 1, further comprising a hole passing through a side of the elliptical ring for allowing a set screw to pass through a surface of the elliptical ring.

8. The automotive wire size adapter of claim 1, wherein the automotive power distribution system includes a graphics display and the graphics display is controlled by a graphics display controller and the graphics display controller is connected to a video input connector mounted on the periphery of an enclosure of the automotive power distribution system.

9. The automotive wire size adapter of claim 1, further comprising a hole passing through a side of the adapter means for allowing a set screw to pass through a surface of the adapter means.

10. A method for adapting a smaller sized wire into a terminal block of an automotive power distribution device, the method comprising:

providing the automotive power distribution system, the automotive power distribution system comprising:

an enclosure;

a plurality of power terminal blocks situated on the periphery of the enclosure, the terminal blocks having elliptical connection openings; and a power distribution device housed within the enclosure, the power distribution device adapted to accept power from one of the plurality of power terminal blocks and the power distribution device adapted to deliver power to another of the plurality of power terminal blocks;

providing an automotive wire size adapter comprising:

an elliptical ring having a length, an inner dimension and an outer dimension, the outer dimension sized to fit snuggly within a selected terminal block of said plurality of terminal blocks, the inner dimension sized to hold a stripped end of the smaller sized wire;

whereas the length is substantially the same size as a depth of the selected terminal block, the inner diameter is sized to accept a stripped end of the smaller power wire and the outer diameter is sized to fit with the selected terminal block;

striping an end of the smaller sized wire;

inserting the stripped end of the smaller sized wire into the automotive wire size adapter;

inserting the automotive wire size adapter into one of the elliptical connection opening of a selected terminal block; and tightening a set screw of the one of the elliptical connection opening, thereby physically holding the automotive wire size adapter and the smaller sized wire firmly within the selected terminal block.

11. The method of claim 10, wherein the automotive wire size adapter is made from a conductive material selected from the group consisting of copper and brass.

12. The method of claim 11, wherein the automotive wire size adapter is plated with a conductive material selected from the group consisting of platinum, nickel, gold, silver and brass.

13. The method of claim 10, wherein the power distribution device passes power from the at least one power input connector through at least one fuse to the at least one power output connector.

14. The method of claim 10, wherein the power distribution device passes power from the at least one power input connector to the at least one power output connector and at least one capacitor is coupled between the at least one power input connector and a ground potential.

15. The method of claim 10, wherein the power distribution device passes power from the at least one power input connector through a power conditioning circuit to the at least one power output connector.

16. The method of claim 10, further comprising a hole passing through a side of the elliptical ring for allowing a set screw to pass through a surface of the elliptical ring.

17. The method of claim 10, wherein the automotive power distribution system includes a graphics display and the graphics display is controlled by a graphics display controller and the graphics display controller is connected to a video input connector mounted on the periphery of an enclosure of the automotive power distribution system.

18. An automotive wire size adapter for use in a terminal block of an automotive power distribution system, the terminal block having at least one elliptical receptacle for accepting a striped end of an elliptical power wire, the automotive wire size adapter comprising:

an elliptical adapter means having a length, an inner dimension and an outer dimension;

whereas the length is substantially the depth of the terminal block, the inner dimension is sized to accept the stripped end of the elliptical power wire and the outer dimension is sized to fit with the terminal block.

19. The automotive wire size adapter of claim 18, wherein the adapter means is made from a conductive material selected from the group consisting of copper and brass.

20. The automotive wire size adapter of claim 19, wherein the adapter means is plated with a conductive material selected from the group consisting of platinum, nickel, gold, silver and brass.

* * * * *